US009541280B2

(12) United States Patent
Robertson

(10) Patent No.: US 9,541,280 B2
(45) Date of Patent: Jan. 10, 2017

(54) ULTRA LOW NOX COMBUSTION FOR STEAM GENERATOR

(71) Applicant: Fives North American Combustion, Inc., Cleveland, OH (US)

(72) Inventor: Thomas F. Robertson, Medina Township, OH (US)

(73) Assignee: FIVES NORTH AMERICAN COMBUSTION, INC., Cleveland, OH (US)

( * ) Notice: Subject to any disclaimer, the term of this patent is extended or adjusted under 35 U.S.C. 154(b) by 240 days.

(21) Appl. No.: 14/295,625

(22) Filed: Jun. 4, 2014

(65) Prior Publication Data

US 2015/0354807 A1 Dec. 10, 2015

(51) Int. Cl.

| | |
|---|---|
| ***F22B 31/04*** | (2006.01) |
| ***F22B 29/06*** | (2006.01) |
| ***F22B 21/34*** | (2006.01) |
| ***F22B 37/62*** | (2006.01) |
| ***F22B 1/00*** | (2006.01) |
| ***F22B 35/10*** | (2006.01) |
| ***F23N 1/08*** | (2006.01) |
| ***F23C 6/04*** | (2006.01) |

(52) U.S. Cl.

CPC ..... *F22B 29/06* (2013.01); *F22B 1/00* (2013.01); *F22B 21/34* (2013.01); *F22B 35/108* (2013.01); *F22B 37/62* (2013.01); *F23C 6/042* (2013.01); *F23C 6/047* (2013.01); *F23N 1/08* (2013.01)

(58) Field of Classification Search

USPC ..... 122/240.2, 406

See application file for complete search history.

(56) References Cited

U.S. PATENT DOCUMENTS

| | | | | |
|---|---|---|---|---|
| 4,279,296 | A * | 7/1981 | Blaskowski | F28D 1/06 165/134.1 |
| 4,289,093 | A * | 9/1981 | Coggins | F22B 21/065 122/197 |
| 4,395,223 | A | 7/1983 | Okigami et al. | |
| 4,403,941 | A | 9/1983 | Okiura et al. | |
| 4,632,064 | A | 12/1986 | Haneda et al. | |
| 4,669,399 | A | 6/1987 | Martin et al. | |
| 4,987,862 | A | 1/1991 | Wittchow et al. | |

(Continued)

OTHER PUBLICATIONS

Thomas F. Robertson, Gregory Johnson, Application of a Novel Low NOx Combustion System to an Oil Field Steam Generator, Symposium, Jun. 1995, 16 pages, SPE 30266 (Society of Petroleum Engineers 30266).

*Primary Examiner* — Alissa Tompkins
*Assistant Examiner* — John Bargero
(74) *Attorney, Agent, or Firm* — Benesch, Friedlander, Coplan & Aronoff LLP

(57) ABSTRACT

A steam generator has a heat exchange chamber with an upstream end and a downstream end. The steam generator further has a burner that injects primary reactants, including fuel and combustion air, into the chamber at the upstream end. A first branch of a once-through water line is located within the chamber downstream of the burner. A second branch of the once-through water line is connected in parallel with the first branch, and is located within the chamber downstream of the first branch. A fuel injector is arranged to inject staged fuel into the chamber at a staged location downstream of the first branch of the once-through water line.

5 Claims, 5 Drawing Sheets

(56) References Cited

U.S. PATENT DOCUMENTS

| | | | | |
|---|---|---|---|---|
| 5,462,430 | A | 10/1995 | Khinkis | |
| 5,975,030 | A * | 11/1999 | Wernig | F22D 1/32 122/32 |
| 6,019,070 | A | 2/2000 | Duffy | |
| 6,250,257 | B1 | 6/2001 | Kastner et al. | |
| 6,289,851 | B1 * | 9/2001 | Rabovitser | F22B 31/04 122/240.2 |
| 6,865,994 | B2 | 3/2005 | Seeker et al. | |
| 7,628,124 | B2 | 12/2009 | Bruckner et al. | |
| 7,959,431 | B2 | 6/2011 | Quinn | |
| 8,002,541 | B2 | 8/2011 | Neville et al. | |
| 8,474,261 | B2 | 7/2013 | Rop | |

* cited by examiner

ULTRA LOW NOX COMBUSTION FOR STEAM GENERATOR

TECHNICAL FIELD

This technology relates to a heating system in which combustion produces oxides of nitrogen (NOx), and specifically relates to a method and apparatus for suppressing the production of NOx in a once through steam generator (OTSG).

BACKGROUND

As viewed from above in the schematic plan view of FIG. 1, a prior art steam generating plant may include multiple steam generators 10 arranged side-by-side. In the illustrated example, each steam generator 10 has a once-through water line 12. The water line 12 at each steam generator 10 has an inlet 14 for receiving a stream of liquid water, and has an outlet 16 for discharging a two-phase mixture of steam and liquid water. The output of the steam generators 10 may be used in processes such as, for example, the enhanced recovery of oil. The water lines 12 at the multiple steam generators 10 may share a common source 17 and one or more process locations 18.

Each steam generator 10 in the illustrated example further has a burner 20, a radiant heating portion 22, and a convective heating portion 24. The radiant heating portion 22 defines an upstream heat exchange chamber 25 with a cylindrical shape. The convective heating portion 24 defines a downstream heat exchange chamber 27 with a generally rectangular shape. The burner 20 fires into the upstream chamber 25. A port 29 communicates the upstream chamber 25 with the downstream chamber 27.

The respective water line 12 at each steam generator 10 first reaches into the downstream chamber 27. Typically, the water line 12 reaches through the downstream chamber 27 along a serpentine path in a stack-like arrangement of parallel sections 30. For example, a single section 30 of the water line 12 is shown in the top view of FIG. 1. Like the other sections 30, this individual section 30 reaches lengthwise in horizontal directions that alternate back and forth across the chamber 27, with multiple horizontal turns 32 of 180 degrees. As shown in the side view of FIG. 2, the multiple horizontal sections 30 of the water line 12 are interconnected by vertical turns 34, with each vertical turn 34 reaching from one horizontal section 30 to the next.

The water line 12 emerges from the downstream chamber 27, and then continues into and through the upstream chamber 25 along another serpentine path before reaching the outlet 16. However, the water line 12 does not reach significantly across the upstream chamber 25, but instead reaches primarily along the periphery of the upstream chamber 25. Specifically, horizontally elongated sections 40 of the water line 12 reach oppositely back and forth along the length of the chamber 25 at its periphery, with turns 42 that interconnect the sections 40 in an array reaching circumferentially around the chamber 25.

The interconnected sections 30 and 40 of each once-through water line 12 are thus arranged in series as heat exchange tubing within the two chambers 25 and 27 in the respective steam generator 10. In operation of the steam generator 10, the respective burner 20 provides gaseous products of combustion that flow through the chambers 25 and 27 and further outward through a stack 50. As the products of combustion flow through the downstream chamber 27, they flow around and against the water line sections 30 that reach across that chamber 27, which results in convective heating of the water flowing through those water line sections 30. The water that is preheated in this manner in the downstream chamber 27 next flows through the water line sections 40 in the upstream chamber 25, where it is further heated radiantly by the products of combustion flowing through the cylindrical space surrounded by those water line sections 40. The two-phase mixture of steam and liquid water is then discharged from the outlet 16.

SUMMARY

A steam generator has a heat exchange chamber with an upstream end and a downstream end. The steam generator further has a burner that injects primary reactants, including fuel and combustion air, into the chamber. A first branch of a once-through water line is located within the chamber downstream of the burner. A second branch of the once-through water line is connected in parallel with the first branch, and is located within the chamber downstream of the first branch. A fuel injector is arranged to inject staged fuel into the chamber at a staged location downstream of the first branch of the once-through water line.

Summarized differently, an apparatus includes an upstream heat exchange chamber, an exhaust stack, and a downstream heat exchange chamber providing gas flow communication from the upstream chamber to the exhaust stack. A burner injects primary reactants, including fuel and combustion air, into the upstream chamber. A once-through water line has a first heat exchange section that is located within the downstream chamber, and has a second heat exchange section that is located within the upstream chamber downstream of the burner. The once-through water line also has a third heat exchange section that is connected in parallel with the second heat exchange section. The third heat exchange section is located within the upstream chamber downstream of the second heat exchange section. The apparatus further includes a fuel injector that injects staged fuel into the upstream chamber at a staged location downstream of the second heat exchange section of the once-through water line.

In a preferred embodiment, a steam generator defines a flow path through a heat exchange chamber, and includes a first tubular wall surrounding a first section of the flow path, a second tubular wall surrounding a second section of the flow path, and a third tubular wall reaching between the first and second tubular walls around a turn in the flow path. A first water line section is located within the first section of the flow path, and a second water line section is located within the second section of the flow path. The first and second water line sections are preferably not connected in series, and are most preferably connected in parallel as parts of a once-through water line. A fuel injector is arranged to inject staged fuel gas into the chamber at a staged location downstream of the first water line section.

A method includes injecting primary reactants, including fuel and combustion air, from a burner into a heat exchange chamber. Liquid water is fed into a first water line that has a section located within the chamber downstream of the burner, and steam is generated in the first water line section. Liquid water is also fed into a second water line section that is located within the chamber downstream of the first water line section, and steam is also generated in the second water line section. Staged fuel, preferably without combustion air, is injected into the chamber at a staged location downstream of the first water line section.

DETAILED DESCRIPTION

Figure 1:
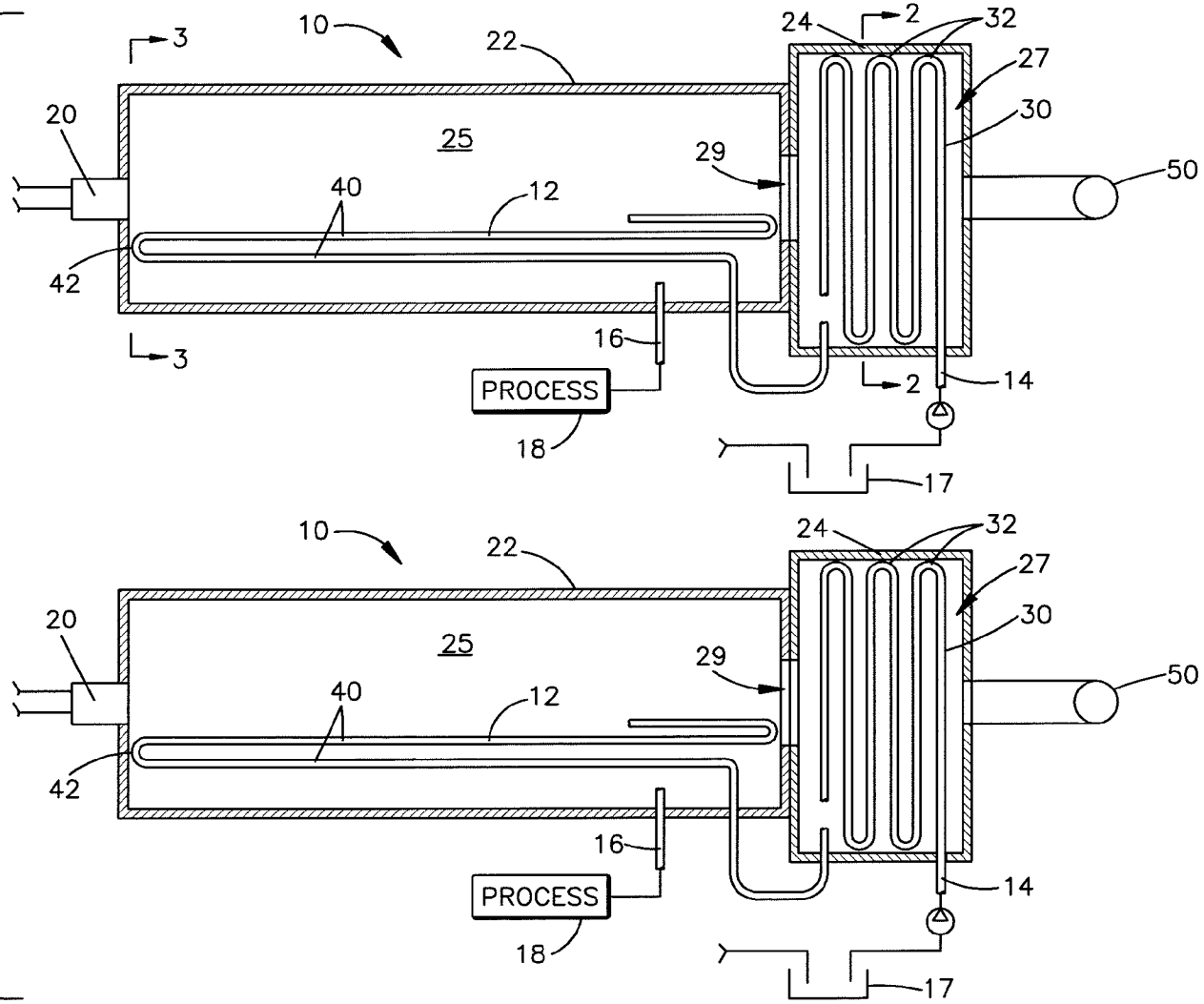
Fig.1 PRIOR ART
FIG. 1 is a schematic plan view of steam generators known in the prior art.
Figure 2:
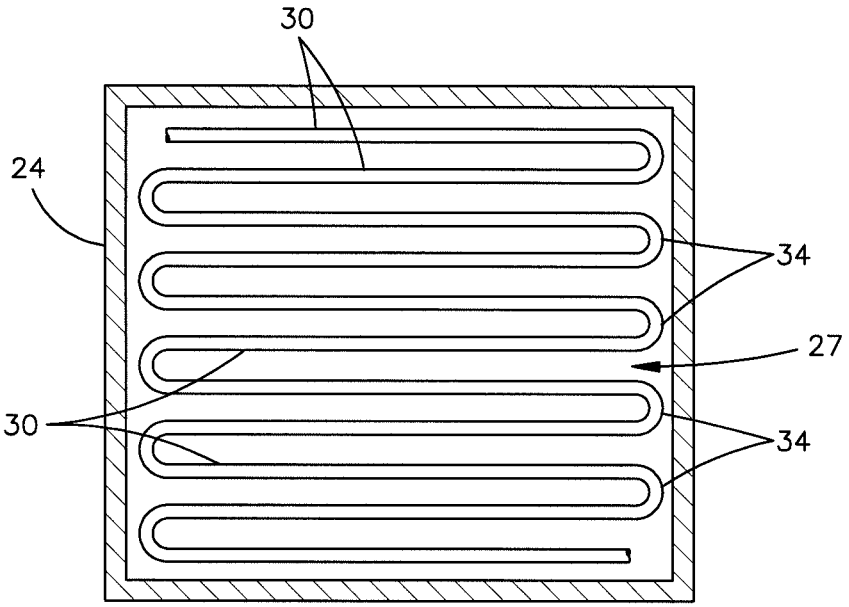
Fig.2 PRIOR ART
FIG. 2 is a schematic view taken on line 2-2 of FIG. 1.
Figure 3:
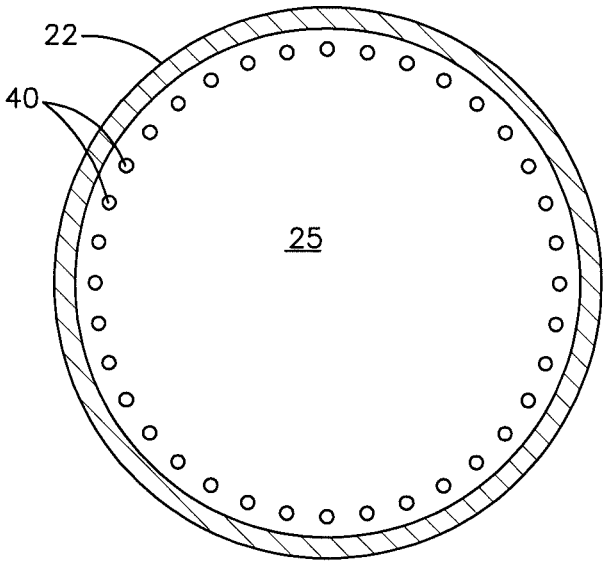
Fig.3 PRIOR ART
FIG. 3 is a schematic view taken on line 3-3 of FIG. 1.

The structures shown schematically in the drawings have parts that are examples of the elements recited in the apparatus claims, and can be operated in steps that are examples of the elements recited in the method claims. The illustrated structures thus include examples of how a person or ordinary skill in the art can make and use the claimed invention. They are described here to meet the enablement and best mode requirements of the patent statute without imposing limitations that are not recited in the claims. The various parts of the illustrated structures, as shown, described and claimed, may be of either original and/or retrofitted construction as required to accomplish any particular implementation of the invention.

Figure 4:
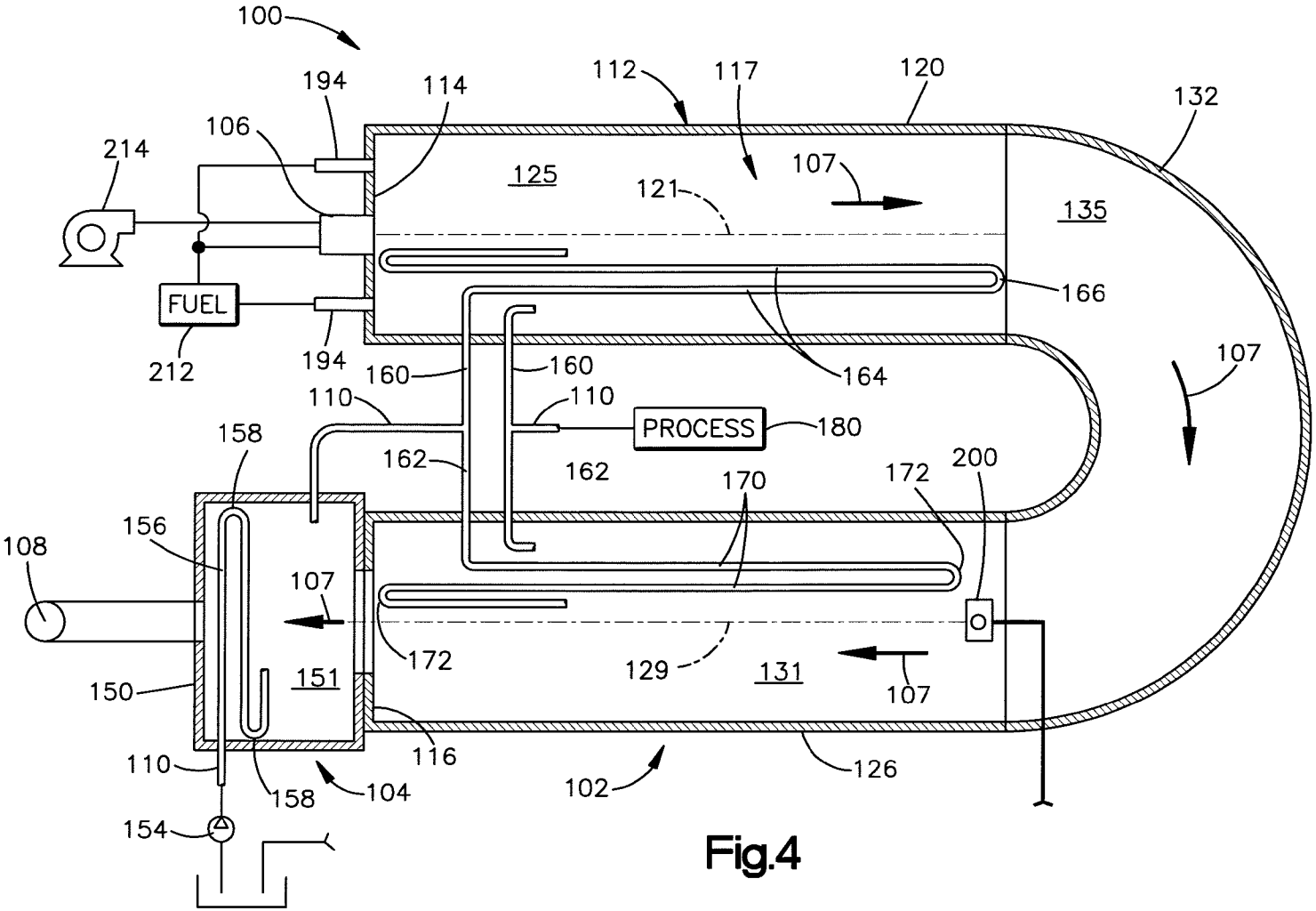
FIG. 4 is a schematic plan view of a steam generator including the invention.

The structure shown schematically in FIG. 4 includes parts of a steam generator 100. In this example, the steam generator 100 has a radiant heating portion 102 and a convective heating portion 104. A burner 106, which is preferably a premix burner, is located at an upstream end of the radiant heating portion 102. The convective heating portion 104 adjoins a downstream end of the radiant heating portion 102. In operation, reactants are provided for products of combustion to flow downstream along a flow path 107 through the radiant and convective heating portions 102 and 104 of the steam generator 100, and then outward through a stack 108. This provides heat for generating steam in a once-through water line 110 that reaches into and through the two portions 102 and 104 of the steam generator 100. By delivering fuel at staged locations along the flow path 107, the invention provides low NOx combustion for generating steam in the water line 110 fully along the length of the flow path 107.

The radiant heating portion 102 of the steam generator 100 includes a U-shaped tubular structure 112 with opposite end walls 114 and 116. An upstream heat exchange chamber 117 extends lengthwise through the tubular structure 112 from the first end wall 114 to the second end wall 116. Specifically, the tubular structure 112 in the illustrated embodiment has multiple tubular walls. A first 120 of these tubular walls is cylindrical with a longitudinal central axis 121, and surrounds a first section 125 of the chamber 117. The first section 125 begins at the first end wall 114, and reaches axially away from the first end wall 114 in a first direction. A second tubular wall 126 is cylindrical with a longitudinal central axis 129, is parallel to the first tubular wall 120, and surrounds a second section 131 of the chamber 117. The second section 131 ends at the second end wall 116, and reaches axially toward the second end wall 116 in a second direction opposite to the first direction.

A third tubular wall 132 reaches between the first and second tubular walls 120 and 126 as a bend around a turn in the chamber 117. In the illustrated example, the third tubular wall 132 surrounds a third section 135 of the chamber 117 that reaches downstream around a turn of 180 degrees between the first and second sections 125 and 131. The tubular structure 112 as a whole, or any one or more of the tubular walls 120, 126 and 132, may be constructed as either a unitary structure or an assembly of joined parts. In each case, the three sections 125, 131 and 135 of the chamber 117 serve as respective sections of the flow path 107.

The convective heating portion 104 of the steam generator 100 has a wall structure 150 defining a downstream heat exchange chamber 151 with a generally rectangular shape. The water line 110 receives liquid water from a pump 154, and reaches through the downstream chamber 151 along a serpentine path. Preferably, the water line 110 has parallel sections 156 that are spaced apart as described above. One such section 156 is shown in FIG. 4, including turns 158 at which that individual section 156 reverses direction across the downstream chamber 151. In this arrangement the multiple sections 156 of the water line 110 reach across the flow path 107 to serve as heat exchange tubing for preheating the liquid water in the downstream chamber 151 primarily by convective heating.

The water line 110 emerges from the downstream chamber 151, and splits into two branches 160 and 162 that reach into and through the upstream chamber 117 in parallel. The first branch 160 reaches through the first section 125 of the upstream chamber 117. The second branch 162 reaches through the second section 131 of the upstream chamber 117. Preferably, the two branches 160 and 162 of the water line 110 do not reach significantly across their respective sections 125 and 131 of the chamber 117, but instead reach primarily along the periphery of the chamber 117 as described above. Accordingly, the first branch 160 of the water line 110 in this embodiment has sections 164 reaching oppositely back and forth along the length of the first section 125 of the chamber 117 at its periphery, with turns 166 that interconnect the sections 164 in an array reaching circumferentially around the axis 121. The second branch 162 in this embodiment likewise has sections 170 reaching oppositely back and forth along the length of the second section 131 of the chamber 117 at its periphery, with turns 172 that interconnect those sections 170 in an array reaching circumferentially around the axis 129.

Each of the two water line branches 160 and 162 receives preheated liquid water from the downstream chamber 151, and serves as heat exchange tubing to generate steam in the upstream chamber 117 primarily by radiant heating. The parallel branches 160 and 162 emerge from the chamber 117 separately, and rejoin for the water line 110 to convey and discharge a mixture of steam and liquid water to one or more steam process locations 180.

The reactants provided for combustion include oxidant and fuel, both of which are delivered to the upstream chamber 117. The oxidant is preferably delivered in a single stage. The fuel is preferably delivered in a primary stage, a second stage, and a third stage simultaneously with delivery of the oxidant in a single stage.

The burner 106 delivers the oxidant and the primary fuel to the upstream chamber 117. As shown in greater detail FIG. 5, the burner 106 is located at the first end wall 114 of the tubular structure 112, and has a port 191 facing into the upstream chamber 117. The port 191 in this example is centered on the longitudinal central axis 121 of the first tubular wall 120.

Secondary fuel injectors 194 deliver the second stage fuel. The secondary fuel injectors 194, two of which are shown in the drawings, have staged locations on the first end wall 114 in an array extending around the axis 121. Each secondary fuel injector 194 has a port 195 (FIG. 5) facing into the chamber 117 along a respective axis 197 that is preferably parallel to the longitudinal axis 121.

Figure 6:
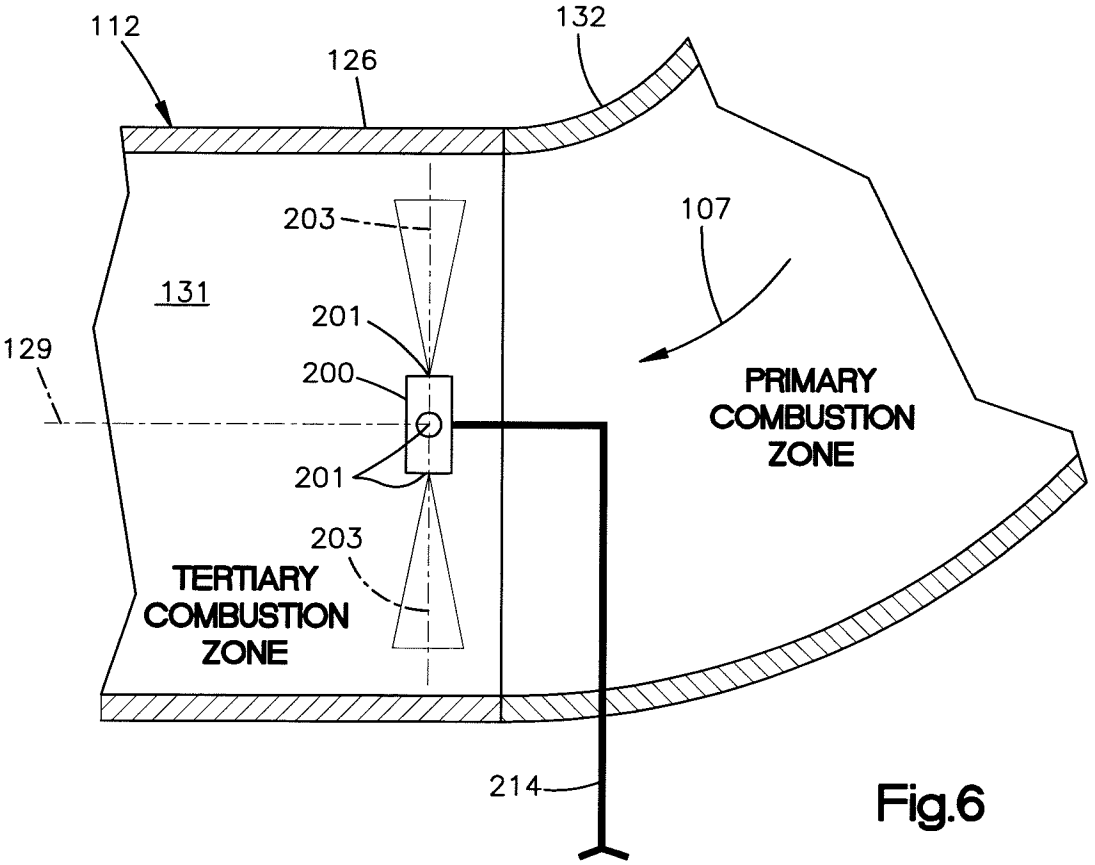
FIG. 6 is an enlarged partial view of other parts of the steam generator of FIG. 4.

A tertiary fuel injector 200 (FIGS. 4 and 6) delivers the third stage fuel to the chamber 117. The tertiary fuel injector 200 is located along the flow path 107 at a staged location. The staged location may be downstream of the first branch 160 of the water line 110, and may be upstream of the second branch 162. As shown in FIG. 4, the tertiary fuel injector 200 in the illustrated embodiment is located between the two branches 160 and 162. As shown in greater detail in FIG. 6, the illustrated injector 200 is centered on the longitudinal axis 129 of the of the second tubular wall 126 at a location within the second section 131 of the chamber 117, and is configured as a manifold with tertiary fuel injection ports 201 facing radially outward along respective axes 203 that are perpendicular to the longitudinal axis 129.

Figure 5:
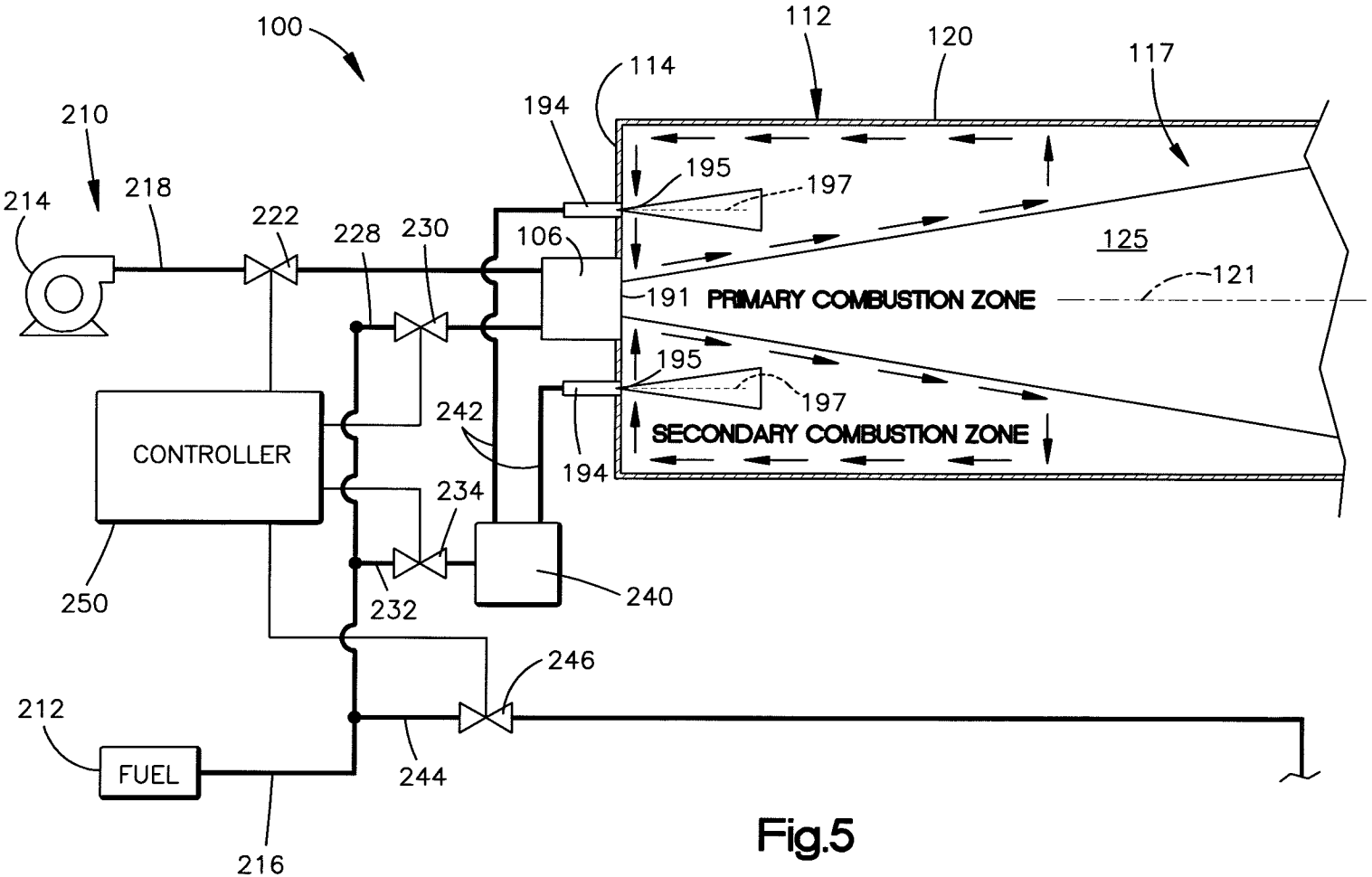
FIG. 5 is an enlarged partial view of parts of the steam generator of FIG. 4.

As further shown in FIG. 5, a reactant supply and control system 210 includes lines and valves that convey the reactants to the burner 106, the secondary fuel injectors 194, and the tertiary fuel injection manifold 200. A fuel source 212, which in this example is a supply of natural gas, and an oxidant source 214, which in this example is a combustion air blower, provide streams of those reactants along respective supply lines 216 and 218.

The oxidant supply line 218 reaches from the blower 214 to the burner 106. An oxidant control valve 222 is located in the oxidant supply line 218 between the blower 214 and the burner 106. Flue gas recirculation from the stack 108 also can be provided at the burner 106.

A first fuel delivery line 228 reaches from the fuel supply line 196 to the burner 106. The first fuel delivery line 228 has a primary fuel control valve 230. A second fuel delivery line 232 has a secondary fuel control valve 234, and extends from the fuel supply line 206 to a fuel distribution manifold 240. The fuel distribution manifold 240 communicates with the secondary fuel injectors 194 through corresponding fuel distribution lines 242. A third fuel delivery line 244 with a tertiary fuel control valve 246 extends from the fuel supply line 196 to the tertiary fuel injection manifold 200 (FIG. 4).

The reactant supply and control system 210 further includes a controller 250 that is operatively associated with the valves 222, 230, 234 and 246 to initiate, regulate and terminate flows of reactants through the valves 222, 230, 234 and 246. Specifically, the controller 250 has combustion controls in the form of hardware and/or software for actuating the valves 222, 230, 234 and 246 in a manner that causes combustion of the reactants to proceed in generally distinct stages that occur in the generally distinct zones identified in FIGS. 5 and 6. Such a controller may comprise any suitable programmable logic controller or other control device, or combination of control devices, that is programmed or otherwise configured to perform as recited in the claims.

In operation, the controller 250 actuates the oxidant control valve 222 and the primary fuel control valve 230 to provide the burner 106 with a stream of oxidant and a stream of primary fuel. Those reactant streams mix together inside the burner 106 to form premix. The premix is delivered to the upstream chamber 117 as a primary reactant stream injected from the port 191 into the first section 125 of the chamber 117 along the longitudinal axis 121. Ignition of the premix occurs within the burner 106. This causes the primary reactant stream to form a primary combustion zone that expands radially outward as combustion proceeds downstream along the axis 121.

The controller 250 actuates the secondary fuel control valve 234 to provide the secondary fuel injectors 194 with streams of second stage fuel. The second stage fuel streams are injected into the first section 125 of the chamber 117 from the secondary ports 195 which, as described above, are located radially outward of the primary port 191. This causes the unignited streams of second stage fuel to form a combustible mixture with reactants and products of combustion that recirculate in the upstream corner portions of the first section 125 of the chamber 117, as indicated by the arrows shown in FIG. 5. Auto-ignition of the combustible mixture creates a secondary combustion zone that surrounds the primary combustion zone at the upstream end portion of the first section 125, as further shown schematically in FIG. 5.

The controller 250 also actuates the tertiary fuel control valve 246 to provide the downstream manifold 200 with third stage fuel. The third stage fuel is delivered to the second section 131 of the chamber 117 in streams that are injected from the tertiary ports 201 in directions extending radially outward along the axes 203. In this manner the third stage fuel is injected into the chamber 117 at a staged location within the primary combustion zone. This causes the streams of third stage fuel to form a combustible mixture with the contents of the primary combustion zone. Auto-ignition of that combustible mixture creates a tertiary combustion zone that extends downstream from the primary zone as combustion in the chamber 117 proceeds downstream through the second section 131 toward the second end wall 116.

In addition to providing the generally distinct combustion zones within the upstream chamber 117, the controller 250 can further control the reactant streams in a manner that maintains fuel-lean combustion throughout the upstream and downstream chambers 117 and 151.

For example, the controller 250 can actuate the valves 222, 230, 234 and 246 to deliver fuel and oxidant to the upstream chamber 117 at target rates of delivery that together have a target fuel to oxidant ratio, with the target rate of oxidant being provided entirely in the primary reactant stream, and with the target rate of fuel being provided at first, second and third partial rates in the primary reactant stream, the second stage fuel streams, and the third stage fuel streams, respectively. Preferably, the first partial target rate of fuel is the highest of the three partial target rates, but is low enough to ensure that the premix, and consequently the primary reactant stream, is fuel-lean. This helps to ensure that combustion in the primary zone is fuel-lean.

The second partial target rate of fuel delivery may be greater than, less than, or equal to the third partial target rate. Suitable values for the first, second and third partial rates could be, for example 60%, 05%, and 35% respectively, of the target rate. However, the second partial rate also is preferably low enough to ensure that the resulting combustion is fuel-lean rather than fuel-rich. This helps to avoid the production of NOx that would occur if the second stage fuel were to form a fuel-rich mixture with the relatively low concentration of oxidant in the gasses that recirculate in the secondary zone. Fuel-lean conditions in the secondary zone also help to avoid the high temperature production of NOx that can occur at the interface between the primary and secondary zones when fuel from the secondary zone forms a combustible mixture with oxidant from the primary zone.

The target fuel-to-oxidant ratio is maintained by injecting the third stage fuel at a third partial rate equal to the balance of the target rate. As the third stage fuel is injected from the manifold 200, it encounters the fuel-lean conditions in the primary combustion zone. This helps to avoid the fuel-rich and thermal conditions that could increase the production of NOx if the third stage fuel were injected directly into the secondary combustion zone along with the second stage fuel. The production of NOx may be further suppressed by diverting some of the target rate of oxidant to one or more staged locations. Such staging of the oxidant in the primary or tertiary combustion zones could prevent the formation of fuel-rich conditions upon delivery of the third stage fuel if combustion in the primary zone has consumed oxidant needed to maintain fuel-lean conditions.

The invention can apply any of the foregoing low NOx combustion techniques to the generation of steam in water line sections having successive locations along a downstream flow path through a heat exchange chamber. This enables a steam generator to operate with a multiple of the steam generating capacity of a prior art steam generator 10 as shown in FIG. 1, especially when the water line sections are not connected in series, as in the preferred embodiment of FIG. 4, and to do so with lesser production of NOx between the burner and the stack.

This written description sets for the best mode of carrying out the invention, and describes the invention so as to enable a person skilled in the art to make and use the invention, by presenting examples of elements recited in the claims. The patentable scope of the invention is defined by the claims, and may include other examples that occur to those skilled in the art. Such other examples, which may be available either before or after the application filing date, are intended to be within the scope of the claims if they have structural or method elements that do not differ from the literal language of the claims, or if they have equivalent structural or method elements with insubstantial differences from the literal language of the claims.

What is claimed is:

1. An apparatus comprising: a steam generator structure defining a gas flow path reaching through heat exchange chambers including a steam-generating chamber and a preheating chamber downstream of the steam-generating chamber; a burner arranged to inject primary reactants, including fuel and combustion air, into the steam-generating chamber; a once-through water line having a) a preheating portion reaching through the preheating chamber, b) a first branch that receives preheated water from the preheating portion and reaches within the steam-generating chamber in a first serpentine configuration of turns and sections that reach oppositely back and forth end-to-end between the turns, and c) a second branch that receives preheated water from the preheating portion in parallel with the first branch and reaches within the steam-generating chamber in a second serpentine configuration of turns and sections that reach oppositely back and forth end-to-end between the turns, with the second serpentine configuration located downstream relative to the gas flow path of the first serpentine configuration; and a fuel injector arranged to inject staged fuel into the steam-generating chamber at a staged location downstream of the first serpentine configuration.

2. The apparatus as defined in claim 1 wherein the staged location is between the first and second serpentine configurations.

3. The apparatus as defined in claim 1 wherein the steam-generating chamber has a first section that contains the first serpentine configuration and reaches downstream in a first direction, and further has a second section that contains the second serpentine configuration and reaches downstream in a second direction opposite to the first direction.

4. The apparatus as defined in claim 1 further comprising an additional fuel injector arranged to inject staged fuel into the steam-generating chamber at a staged location upstream of the first serpentine configuration.

5. The apparatus as defined in claim 4 further comprising a system configured to deliver fuel and combustion air to the steam-generating chamber at target rates that together have a target fuel-to-oxidant ratio by a) delivering the entire target rate of combustion air and a first partial target rate of fuel to the burner for injection as primary reactants, b) simultaneously delivering a second partial target rate of fuel to the additional fuel injector for injection as second stage fuel, and c) simultaneously delivering the balance of the target rate of fuel to the fuel injector for injection as third stage fuel.

* * * * *